US005117848A

United States Patent [19]

Huang

[11] Patent Number: 5,117,848

[45] Date of Patent: Jun. 2, 1992

[54] COMBINED TOOTHBRUSH AND PEN-SHAPED CASING

[76] Inventor: Scott Huang, 3F, No. 65, Lane 277, Hsin-Tai Rd., Hsin-Chuang City, Taipei Hsien, Taiwan

[21] Appl. No.: 783,841

[22] Filed: Oct. 29, 1991

[51] Int. Cl.[5] ..... A46B 11/00

[52] U.S. Cl. ..... 132/308; 132/311; 401/125

[58] Field of Search ..... 401/125; 132/311, 308

[56] References Cited

U.S. PATENT DOCUMENTS

| | | | |
|---|---|---|---|
| 1,520,954 | 12/1924 | Kastelle | 401/125 |
| 2,620,500 | 12/1952 | Ridner, Sr. | 132/308 X |
| 2,640,488 | 6/1953 | Velodota | 132/308 |
| 2,763,020 | 9/1956 | Newlin | 401/125 |
| 3,991,776 | 11/1976 | Duffy | 132/311 |

*Primary Examiner*—Steven A. Bratlie
*Attorney, Agent, or Firm*—Ladas & Parry

[57] ABSTRACT

A combined toothbrush and pen-shaped casing includes a pen-shaped casing. The pen-shaped casing includes a clip, a barrel, and a tubular cover adapted to cover the barrel. The tubular cover has a closed end, an open end, and a surrounding side interconnecting the closed and open ends to define a first receiving space. The surrounding side has an axially extending notch. An inverted U-shaped channel providing member is disposed adjacent to the notch and connected to the closed end and to the surrounding side. The channel providing member defines a second receiving space accessible via the notch. A toothbrush is removably confined in the pen-shaped casing and includes a head with bristles and a handle. The head is received in the first receiving space, the bristles extend into the second receiving space, and the handle extends into the barrel when the toothbrush is confined in the pen-shaped casing. An end of the handle engages an end of the barrel when the toothbrush is removed from the pen-shaped casing.

4 Claims, 2 Drawing Sheets

COMBINED TOOTHBRUSH AND PEN-SHAPED CASING

BACKGROUND OF THE INVENTION

1. Field of the Invention

This invention relates to a toothbrush, more particularly to a combined toothbrush and pen-shaped casing.

2. Description of the Related Art

It is inconvenient for a person to take a conventional toothbrush along when going out. When the toothbrush is put into a handbag, the bristles of the toothbrush are easily worn. Furthermore, it is unpleasant for a person to place the toothbrush in his/her pocket.

SUMMARY OF THE INVENTION

Therefore, the objective of this invention is to provide a toothbrush combined with a pen-shaped casing for receiving the toothbrush therein. The combined toothbrush and pen-shaped casing is adapted to be put into a handbag, a pocket, etc.

Accordingly, a combined toothbrush and pen-shaped casing of this invention includes an upright pen-shaped casing. The pen-shaped casing includes a clip mounted thereon; a lower barrel which has an open first top end, a first bottom end, and an outer surface; and an upper tubular cover adapted to cover the barrel. The tubular cover has a closed second top end, an open second bottom end, and a surrounding side interconnecting the second top and bottom ends to define a first receiving space. The surrounding side has a notch extending from the second top end to the second bottom end. An inverted U-shaped channel providing member is disposed adjacent to the notch and connected to the second top end and to the surrounding side. The channel providing member defines a second receiving space accessible via the notch.

A toothbrush is removably confined in the pen-shaped casing. The toothbrush includes a head with bristles and a handle connected to the head. The head is received in the first receiving space, the bristles extend into the second receiving space, and the handle extends downwardly into the barrel when the toothbrush is confined in the pen-shaped casing. The handle has an end adapted to engage the first bottom end of the barrel when the toothbrush is removed from the pen-shaped casing.

BRIEF DESCRIPTION OF THE DRAWING

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
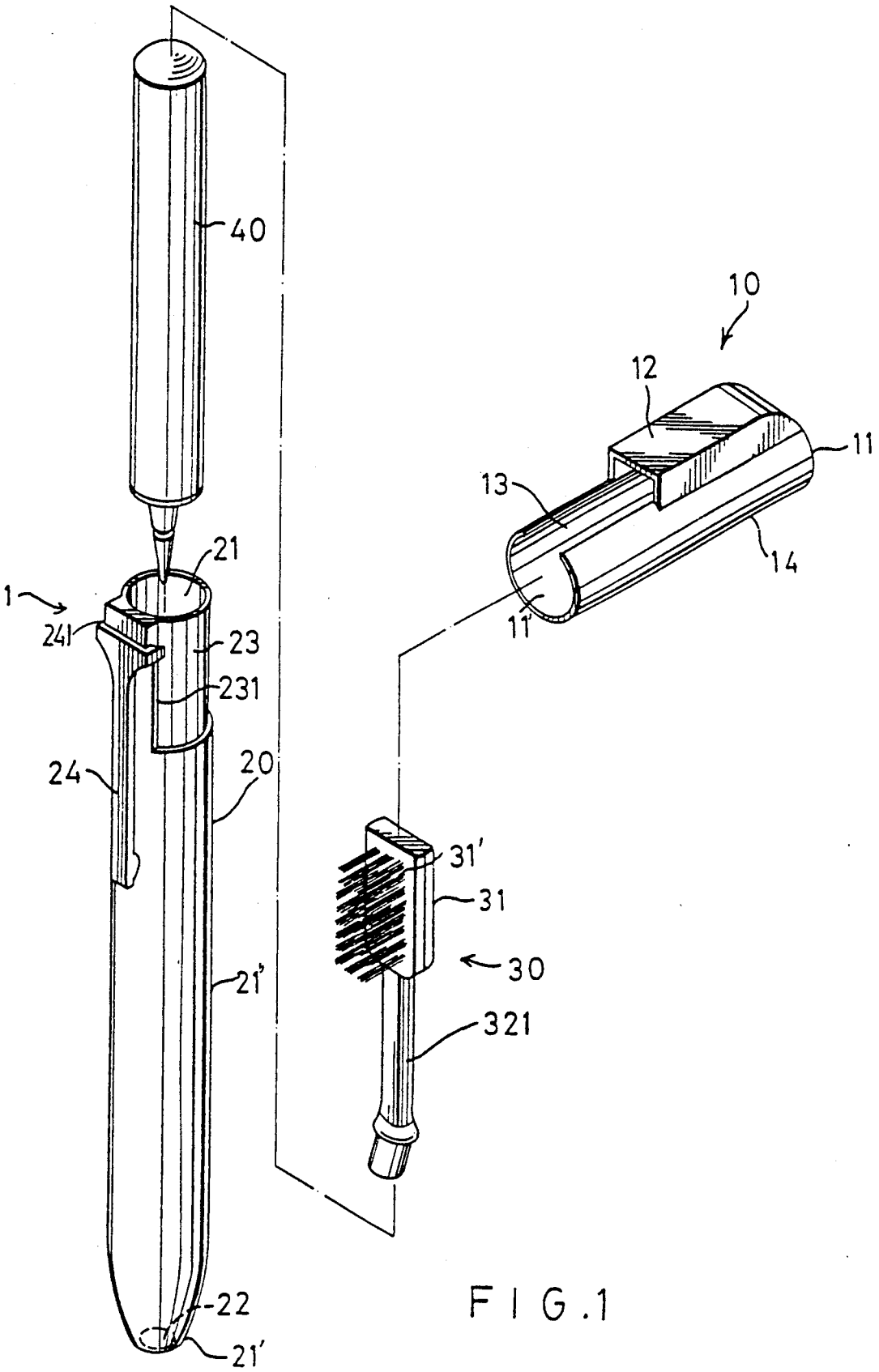
FIG. 1 is an exploded view of a combined toothbrush and pen-shaped casing of this invention.
Figure 2:
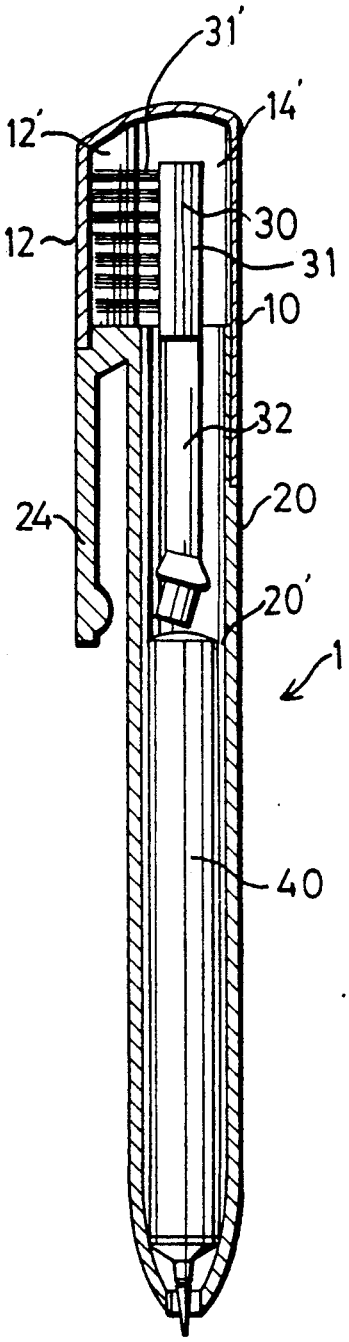
FIG. 2 is a schematic view of this invention showing a toothbrush confined in a pen-shaped casing.
Figure 3:
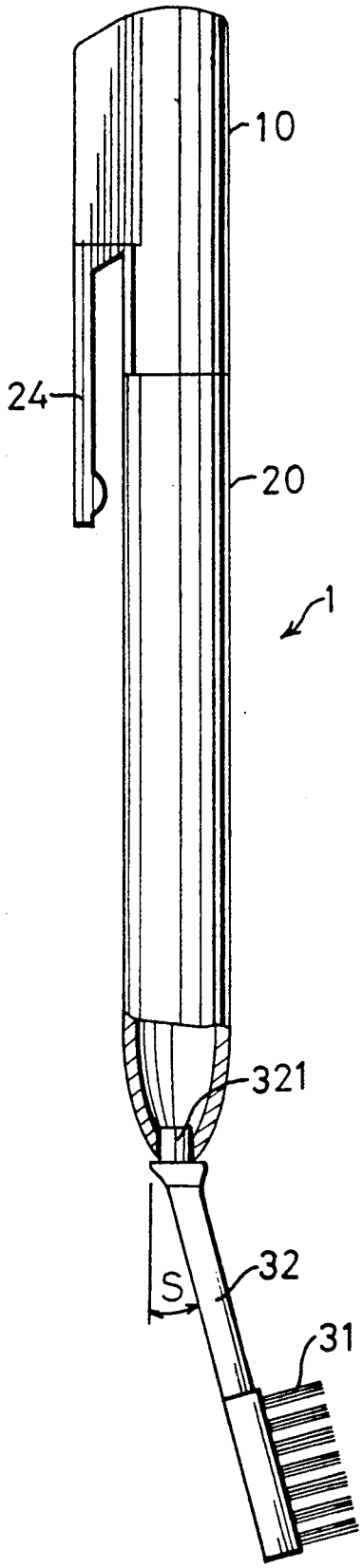
FIG. 3 is a schematic view of this invention showing a toothbrush engaging a bottom end of a pen-shaped casing.

Referring to FIGS. 1 to 3, a combined toothbrush and pen-shaped casing of this invention has an upright pen-shaped casing (1) which includes a lower barrel (20) and an upper tubular cover (10) adapted to cover the barrel (20). The barrel (20) has an open first top end (21), a first bottom end (21') which is formed with a hole (22), an outer surface (21''), and an inner receiving space (20') for receiving a container (40) of toothpaste therein. The outer surface (21'') is formed with a surrounding peripheral recess (23) adjacent to the first top end (21). The surrounding peripheral recess (23) has an axially extending raised portion (231) formed thereon and extending from the first to end (21). A clip (24) has a shoulder (241) attached to the raised portion (231).

The tubular cover (10) has a closed second top end (11), an open second bottom end (11'), and a surrounding side (14) interconnecting the second top and bottom ends (11, 11') to define a first receiving space (14'). The surrounding side (14) has a notch (13) extending from the second top end (11) to the second bottom end (11'). An inverted U-shaped channel providing member (12) is disposed adjacent to the notch (13) and connected to the second top end (11) and to the surrounding side (14). The channel providing member (12) covers an upper portion of the notch (13) and defines a second receiving space (12') accessible via the notch (13). When the tubular cover (10) covers the barrel (20), the lower portion of the surrounding side (14) engages the peripheral recess (23). The raised portion (231) extends into the lower portion of the notch (13). The channel providing member (12) seats against the shoulder (241).

A toothbrush (30) is removably confined in the pen-shaped casing (1). The toothbrush (30) includes a head (31) with bristles (31') and a handle (32) connected to the head (31). The handle (32) has a plug (321) extending downwardly therefrom. The handle (32) and the plug (321) form a predetermined angle (S) therebetween. The plug (321) is adapted to detachably engage the hole (22) of the barrel (20). When the toothbrush (30) is confined in the pen-shaped casing (1), the head (31) is received in the first receiving space (14'), and the bristles (31') extend into the second receiving space (12'). The handle (32) extends downwardly into the barrel (20). When the toothbrush (30) is removed from the pen-shaped casing (1), the plug (321) engages the hole (22) of the barrel (20). Since the plug (321) and the handle (32) form the predetermined angle (S) therebetween, the pen-shaped casing (1) and the handle (32) also form the predetermined angle (S) therebetween so as to facilitate the brushing of teeth.

When going out, the combined toothbrush and pen-shaped casing of this invention is convenient to carry. When the combined toothbrush and pen-shaped casing is placed in a handbag, the toothbrush does not wear because it is confined in the pen-shaped casing (1). The combined toothbrush and pen-shaped casing is aesthetically more pleasing than a conventional toothbrush when it is attached to a pocket by means of the clip (24).

While the present invention has been described in connection with what is considered the most practical and preferred embodiment, it is understood that this invention is not limited to the disclosed embodiments, but is intended to cover various arrangements included within the spirit and scope of the broadest interpretations and equivalent arrangements.

I claim:

1. A combined toothbrush and pen-shaped casing comprising:

an upright pen-shaped casing including: a clip mounted thereon; a lower barrel which has an open first top end, a first bottom end, and an outer surface; and an upper tubular cover adapted to cover said barrel, said tubular cover having a closed second top end, an open second bottom end, and a surrounding side interconnecting said second top and bottom ends to define a first receiving space, said surrounding side having a notch extending from said second top end to said second bottom end, an inverted U-shaped channel providing member disposed adjacent to said notch and connected to said second top end and said surrounding side, said channel providing member defining a second receiving space accessible via said notch; and a toothbrush removably confined in said pen-shaped casing, said toothbrush including a head with bristles and a handle connected to said head; said head being received in said first receiving space, said bristles extending into said second receiving space, and said handle extending downwardly into said barrel when said toothbrush is confined in said pen-shaped casing; said handle having an end adapted to engage said first bottom end of said barrel when said toothbrush is removed from said pen-shaped casing.

2. A combined toothbrush and pen-shaped casing as claimed in claim 1, wherein said clip is attached to said outer surface of said barrel.

3. A combined toothbrush and pen-shaped casing as claimed in claim 1, wherein said first bottom end of said barrel is formed with a hole, said end of said handle having a plug to detachably engage said hole.

4. A combined toothbrush and pen-shaped casing as claimed in claim 3, wherein said handle and said plug form a predetermined angle therebetween.

* * * * *